US011766714B2

(12) United States Patent
Costa et al.

(10) Patent No.: US 11,766,714 B2
(45) Date of Patent: Sep. 26, 2023

(54) METHOD OF FORMING A ROLL BODY OR ROLL MANTLE

(71) Applicant: AKTIEBOLAGET SKF, Gothenburg (SE)

(72) Inventors: Patrik Costa, Älvängen (SE); Mats Johansson, Västra Frölunda (SE); Erik Mitchell, Hovås (SE)

(73) Assignee: AKTIEBOLAGET SKF, Gothenburg (SE)

( * ) Notice: Subject to any disclaimer, the term of this patent is extended or adjusted under 35 U.S.C. 154(b) by 0 days.

(21) Appl. No.: 17/584,721

(22) Filed: Jan. 26, 2022

(65) Prior Publication Data

US 2022/0143683 A1 May 12, 2022

Related U.S. Application Data

(62) Division of application No. 16/945,984, filed on Aug. 3, 2020, now Pat. No. 11,285,530.

(30) Foreign Application Priority Data

Sep. 16, 2019 (DE) ..... 102019214056.4

(51) Int. Cl.
*B22D 11/128* (2006.01)
*F28F 21/08* (2006.01)
(Continued)

(52) U.S. Cl.
CPC ..... *B22D 11/1287* (2013.01); *B22C 9/28* (2013.01); *B22D 11/124* (2013.01);
(Continued)

(58) Field of Classification Search
CPC ..... B22D 15/005; B22D 11/128; B22D 11/1287; B22C 9/28; B22C 9/10
See application file for complete search history.

(56) References Cited

U.S. PATENT DOCUMENTS 1,374,517 A * 4/1921 Nichols ..... B22D 15/005 164/126
2,173,955 A * 9/1939 Zahn ..... B22D 15/005 164/348
(Continued)

FOREIGN PATENT DOCUMENTS

DE 1583619 A1 8/1970
DE 102004003520 B3 5/2005
(Continued)

OTHER PUBLICATIONS

Office Action from the Austrian Patent Office dated Feb. 22, 2023 in related application No. A 50632/2020, and machine translation thereof.

*Primary Examiner* — Kevin E Yoon
(74) *Attorney, Agent, or Firm* — J-TEK LAW PLLC; Scott T. Wakeman; Mark A. Ussai

(57) ABSTRACT

A method for manufacturing a roll mantle or roll body for a roll line of a continuous casting apparatus that has a shaft includes casting a metal to form the roll mantle or roll body such that the roll mantle or roll body includes at least one internal channel. The roll mantle or roll body has a first end region, a second end region and a central region between the first end region and the second end region, the central region extending along at least 50% of a length of the roll mantle or roll body, and the internal channel may be formed in the central region. The internal channel may also include a pattern or projection.

15 Claims, 5 Drawing Sheets

(51) Int. Cl.

| | |
|---|---|
| ***F28F 5/02*** | (2006.01) |
| ***B22D 11/124*** | (2006.01) |
| ***B22D 15/00*** | (2006.01) |
| ***B22C 9/28*** | (2006.01) |

(52) U.S. Cl.
CPC ..... *B22D 15/005* (2013.01); *F28F 5/02* (2013.01); *F28F 21/081* (2013.01)

(56) References Cited

U.S. PATENT DOCUMENTS

| | | | | |
|---|---|---|---|---|
| 2,374,904 | A * | 5/1945 | Walcher ..... | B22D 15/005 164/334 |
| 4,402,233 | A | 9/1983 | Toivonen et al. | |
| 2003/0094219 | A1 | 5/2003 | Rode et al. | |
| 2006/0191662 | A1 | 8/2006 | Deibl et al. | |
| 2010/0206512 | A1* | 8/2010 | Dube ..... | B22D 29/001 164/6 |

FOREIGN PATENT DOCUMENTS

| | | | |
|---|---|---|---|
| EP | 1314495 | A2 | 5/2003 |
| EP | 1646463 | B1 | 3/2007 |
| EP | 2682202 | A2 | 1/2014 |
| EP | 2682203 | A2 | 1/2014 |
| EP | 2682204 | A2 | 1/2014 |
| JP | H01127160 | A | 5/1989 |
| WO | 9319874 | A1 | 10/1993 |
| WO | 2015034421 | A1 | 3/2015 |

* cited by examiner

METHOD OF FORMING A ROLL BODY OR ROLL MANTLE

CROSS-REFERENCE

This application is a division of U.S. Ser. No. 16/945,984, filed Aug. 3, 2020, which claims priority to German patent application no. 10 2019 214 056.4 filed on Sep. 16, 2019, the contents of which are fully incorporated herein by reference.

TECHNOLOGICAL FIELD

The present disclosure is directed to a roll mantle or a roll body (i.e. an integrated roll mantle and shaft) having at least one internal channel which is suitable for a roll line of a continuous casting apparatus, and a method for producing such a roll mantle or roll body.

BACKGROUND

In a continuous casting process molten metal flows from a ladle, through a tundish into a mold having water-cooled walls. Once in the mold, the molten metal solidifies against the water-cooled mold walls to form a solid shell. This shell containing the liquid metal, now called a strand, is withdrawn continuously from the bottom of the mold. The strand is supported by closely spaced, water-cooled roll lines which act to support the walls of the strand against the ferrostatic pressure of the still-solidifying liquid within the strand. To increase the rate of solidification, the strand is sprayed with large amounts of water. Finally, the strand is cut into predetermined lengths. The strand may then continue through additional roll lines and other mechanisms which flatten, roll or extrude the metal produce into its final shape.

Since cast metal strands leave the mold at a temperature above 900° C., in particular in the case of steel strands, the roll mantles or roll bodies of the roll lines are usually provided with internal cooling to facilitate cooling of the strands passing over them and to extend the useful service life of the roll mantles or roll bodies.

Apart from high temperatures, the roll lines used in continuous casting plants are also subjected to extreme wear due to the high loads, large temperature variations, high humidity, high corrosion, abrasion, and high contamination to which they are subjected during use. Their service life is relatively short compared with other components used in a continuous casting plant. For this reason, the roll lines have to be exchanged for new roll lines or overhauled roll lines frequently. If the roll lines fail, they have to be substituted within the shortest possible time so that down time of the continuous casting plant is minimized. The roll lines are relatively large and heavy, and exchanging them is difficult and time consuming.

Often, different materials are used in different parts of a roll mantle or roll body. More corrosion-resistant material (such as steel with a higher alloy content) is used for the outer surface of the roll mantle or roll body which comes into contact with metal strands, while material having a greater mechanical strength (such as steel with a higher carbon content) is used for the core of the roll mantle or roll body. Alternatively, or additionally a protective coating may be applied to the exterior surfaces of a roll mantle or roll body. For example, weld cladding may be used to apply a thin layer of a high performance alloy, such as a chrome-nickel based super alloy, to improve the wear and corrosion resistance of the roller mantle or roll body.

European patent application no. EP 1,646,463 (family member of U.S. Pat. No. 7,325,586) relates to an internally cooled strand-guiding roller for a continuous casting installation. The strand-guiding roller comprises a central rotary shaft and at least one cylindrical roller tube which is supported on said shaft in a rotationally fixed manner. Coolant channels located at a constant distance from the outer surface of the cylindrical roller tube, pass through the roller tube. The coolant passages are distributed uniformly in the interior of the cylindrical roller tube at, or near its periphery, and are formed by through bores. Coolant from a coolant line, which is arranged in the central rotary shaft, is supplied to the coolant passages at one end of the cylindrical roller tube and returned from the coolant passages to the coolant line at the other end of the cylindrical roller tube via branch lines that extend radially through the cylindrical roller tube between the coolant passages and the coolant line.

There is a risk that a rotary shaft supporting cylindrical roller tubes such as the strand-guiding rollers disclosed in EP 1,646,463 will be weakened at its end regions where the coolant passages are located, since the end regions of the shaft close to the ends of the cylindrical roller tubes are subjected to the highest mechanical stresses during use.

Additionally, such cylindrical roller tubes are manufactured by producing a metal cylinder without any coolant passages and then creating the coolant passages by machining, for example by drilling through the metal cylinder. Drilling from the inside of a cylindrical roller tube can however be very complex and time consuming, especially when drilling at an angle to the inner surface of the cylindrical roller tube or when drilling through high strength steel. Furthermore, such a manufacturing process produces coolant passages having sharp edges with inner surfaces that have been mechanically damaged by drilling tools. Indentations and projections on the inner surface of a coolant passage can result in debris collecting in the coolant passages which can adversely affect the flow of coolant through the coolant passages. Furthermore, certain geometries, arrangements, and radii of curvature of internal channels may be impossible to achieve by machining, which limits a manufacturer's design options.

SUMMARY

An aspect of the disclosure is to provide an improved roll mantle or roll body that is suitable for a roll line of a continuous casting apparatus comprising a non-integrated or integrated shaft respectively, whereby the roll mantle or roll body is arranged to be supported on the shaft, whereby the roll mantle or roll body comprises at least one internal channel, and an improved method for manufacturing such a roll mantle or roll body.

This is achieved by a roll mantle or roll body comprising at least one internal channel which has been produced by casting, i.e. the roll mantle or roll body and its at least one internal channel are produced simultaneously by casting. The internal channels are not produced by machining.

A roll mantle or roll body including at least one internal channel according to the present disclosure may be produced by near-net-shape casting, where the initial part production provides a quality surface finish and geometry which is close to the final (net) shape. The amount of machining and surface finishing required for the final cast roll mantle or roll body will thereby be reduced or eliminated. Reducing or eliminating the need for machining and grinding can eliminate a substantial part of the production cost. Additionally, very close tolerances can be achieved with material waste reduced to a minimum. Furthermore, casting allows more complex geometries and arrangements of internal channels to be produced, and the internal channels may have any desired shape, size and/or radius of curvature, providing the manufacturer with a lot more design options, which would otherwise be un-economical or very difficult, if not impossible, to produce using conventional methods.

The technical content of the disclosure lies not in the casting process per se, but rather in the technical properties imparted to the roll mantle or roll body by the casting process. The at least one internal channel may namely be designed and cast so that the flow of a fluid, such as coolant, through the at least one channel is optimized as well as the circulation of fluid through the roll mantle or roll body. At least part of an internal channel may for example be cast with a smooth, rounded inside surface without sharp edges or indentations or projections to prevent debris from collecting in the internal channel. Additionally or alternatively, at least one part of the inside surface of an internal channel may be provided with a pattern or at least one feature, such as a projection or a cooling fin, during casting so as to create turbulence in a fluid flowing through the at least one internal channel and/or to increase the surface contact area when the roll mantle or roll body is in use. The cast roll mantle or roll body with therefore exhibit improved internal cooling.

The expression "internal channel" as used herein is intended to mean any cavity, hole or passage of any shape or size which can contain and/or conduct fluid, or contain an object, such as at least part of a sensor or equipment, such as an electronic device. It includes all cavities, holes and passages located radially inwards of the outer surface of the roller mantle apart from a center bore of a roll mantle or roll body for receiving a shaft, i.e. a roller mantle or roll body according to the present disclosure comprises at least one internal channel other than a center bore for receiving a shaft. An internal cavity is preferably not machined after a roll mantle or roll body has been cast. At least part of an internal cavity may however be machined after a roll mantle or roll body has been cast.

A roll mantle or roll body according to the present disclosure is not necessarily a hollow cylinder and does not necessarily have a continuous or a smooth outer surface. It can have any uniform or non-uniform, symmetric or non-symmetric shape, size and/or cross section. The outer surface of the roll mantle or roll body may be continuous or non-continuous. It may have an even or uneven, regular or irregular outer surface, which is either free from perceptible projections or indentations or which contains perceptible projections or indentations.

The expression "outer surface of the roll mantle or roll body" as used herein is intended to mean the surface that is arranged to come into contact with cast metal strands during a continuous casting process. The expression "length of the roll mantle or roll body" is intended to mean the length of this outer surface as measured from one end region of the roller mantle to the other end region of the roller mantle.

The expression "a shaft" is intended to mean at least one rotating or non-rotating bar that is used to support one or more roll mantles or an integral part of a roll body. The cross-section of a shaft usually, but not necessarily, circular. The expression "a shaft" is intended to mean either a single shaft that passes through the entire length of a roll mantle, or a plurality of shafts which support only the ends of a roller mantle but do pass through the entire length of the roll mantle.

According to an embodiment of the disclosure, the continuous casting apparatus comprises a rotatable shaft, whereby the roll mantle or roll body is arranged to be supported on the shaft in a rotationally fixed manner, whereby the rotatable shaft comprises a coolant line and the at least one internal channel constitutes at least one internal coolant channel that is arranged to conduct a coolant, such as water or any other fluid (i.e. liquid or gas) or mixture of fluids, through the roll mantle or roll body and to be in fluid communication with the coolant line of the rotatable shaft.

It should be noted that the expression "a rotatable shaft having a coolant line" is not necessarily intended to mean a rotatable shaft having a single coolant line. A rotatable shaft may be arranged to have any number of coolant lines.

According to an embodiment of the disclosure, the roll mantle or roll body comprises a first end region, a second end region, and a central region in between the first end region, and the second end region, whereby the at least one internal channel has at least one inlet located in the central region of the roll mantle or roll body and/or at least one outlet located in the central region of the roll mantle or roll body and whereby the central region extends along at least 50% of the length of the roll mantle or roll body, or at least 60%, at least 70%, or at least 80% of the length of the roll mantle or roll body.

By arranging one or more internal channels, one or more inlets and/or one or more outlets at the center of the roll mantle or roll body or within a central region of the roll mantle or roll body and not within the end regions of the roll mantle or roll body, stress levels are lower and there will be no exposed sealing means at the end regions of the roll mantle or roll body. The end regions of the roll mantle or roll body are namely subjected to high loads, high temperatures, high temperature variations, high humidity, high corrosion and high contamination. The detrimental effect of these conditions are reduced or avoided by locating the inlet(s) and/or outlet(s) and any necessary sealing means at a less loaded, more protected, and relatively cool part of the roll mantle or roll body and shaft. The lifetime of sealing means around the inlet(s) and/or outlet(s) will consequently be extended and the sealing means will not have to be replaced as frequently as sealing means located at the end regions of a roller mantle. According to an embodiment of the disclosure, seals may be used at the end regions and/or the central region of the roll mantle or roll body.

It should however be noted that one or more internal channel inlets or outlets may be located at one or both ends or end regions of a roll mantle or roll body. Sealing means may then be provided between the shaft of the roll line and the roll mantle or roll body. Rubber seals or O-rings may for example be used to seal off the area between a coolant line of a shaft and the coolant inlet and/or coolant outlet of the roll mantle or roll body.

According to an embodiment of the disclosure, the at least one internal channel is arranged so as be usable for at least one of the following: to contain coolant, to house equipment, to house at least part of a sensor, to contain a fluid that facilitates assembly and/or disassembly of a roll line, such as hydraulic oil, which may be used to separate the roll mantle or roll body from the shaft, to contain lubricant, to allow access to the at least one internal channel from the outside of the roll mantle or roll body when the roll mantle or roll body is supported on the rotatable shaft for inspection and/or cleaning.

According to an embodiment of the disclosure, the at least one internal channel has an inside surface and at least part of the inside surface comprises a pattern, i.e. any regular or non-regular marking(s) and/or at least one feature, such as a projection (a cooling fin for example), which is/are produced by casting when manufacturing the roll mantle or roll body. The pattern and/or the at least one feature is/are arranged to achieve at least one of the following: to control a flow of a fluid flowing through the at least one internal channel, to create turbulence in a fluid flowing through the at least one internal channel, to provide an increased contact surface area to facilitate cooling of the roll mantle or roll body, to facilitate mounting of equipment inside the internal channel, such as at least part of a sensor. The pattern and/or at least one feature is/are produced during casting, using a suitable mold.

According to an embodiment of the disclosure, an outer surface of the roll mantle or roll body comprises a pattern, and/or at least one feature, such as a projection, which is/are produced by casting when the roll mantle or roll body including at least one internal channel is being manufactured. Such a pattern or feature may be used to facilitate the transportation or cooling of cast metal strands that comes into contact with the outer surface of the roll mantle or roll body when the roll mantle or roll body is in use.

According to an embodiment of the disclosure, the at least one internal channel comprises at least one of the following features: a uniform or non-uniform cross-section, a uniform or non-uniform cross-sectional area, an extension at a constant or non-constant distance from an outer surface of the roll mantle or roll body, a circular cross-section, a rounded inside surface, a conical geometry and/or a partition wall. At least one part of the at least one internal channel may be arranged to extend in a straight line parallel to the outer surface of the roll mantle or roll body, or at an angle to the outer surface of the roll mantle or roll body. It should however be noted that the at least one internal channel does not necessarily have to extend in a straight line through the roll mantle or roll body. The at least one internal channel may for example extend in a curved line, or in the form of a spiral, a zig-zag, a regular or irregular pattern, or in any other suitable manner through the roll mantle or roll body.

The expression "inner surface of the at least one internal channel" is intended to mean the surface that limits the boundary of the internal channel, i.e. the surface of a coolant channel that comes into contact with the coolant. At least one part of the inner surface may be cast so as to be free of sharp corners, grooves and projections in or around which debris can collect, unless such features are desired and intentionally created when casting the roll mantle or roll body According to an embodiment of the disclosure, the at least one internal channel is arranged to extend along a maximum of 70% of the length of a roll mantle or roll body, or a maximum of 60% of the length of a roll mantle or roll body or a maximum of 50% of the length of a roll mantle or roll body. Shorter internal channels may namely be easier to cast than longer internal channels.

The present disclosure also concerns a method for manufacturing a roll mantle or roll body according to any of the embodiments of the present disclosure, namely a roll mantle or roll body for a roll line of a continuous casting apparatus comprising a shaft, whereby the roll mantle or roll body is arranged to be supported on the shaft and comprises at least one internal channel. The method comprises the step of producing the roll mantle or roll body including the at least one internal channel by casting.

The expression "casting" may include sand, continuous or die casting, whereby a molten metal is poured into a mold which contains a hollow cavity of the desired shape, and then allowed to solidify. The solidified part is ejected or broken out of the mold to complete the process.

It should be noted that the expression "casting" as used herein does not include centrifugal casting, which has been used to manufacture rotationally symmetric stock materials without internal channels in standard sizes for further machining, such as thin-walled steel cylinders, rather than shaped parts tailored to a particular end use. In centrifugal casting, a permanent mold is rotated continuously at high speeds (up to 3000 rpm) at a centripetal acceleration of 120-150 g as molten metal is poured. The molten metal spreads along the inside mold wall, where it solidifies after cooling. Often the inner and outermost layers are removed by machining and only the intermediary columnar zone is used. It is not possible to use centrifugal casting to produce a roll mantle or roll body comprising at least one internal channel because it is impossible to retain a mold that is required to create at least one internal channel, such as a sand core structure, in the centrifugal casting machine. Consequently, the advantages and preferred properties of the disclosure cannot be realized with centrifugal casting.

According to an embodiment of the disclosure, the method comprises the step of casting the roll mantle or roll body comprising at least one internal channel in a single piece and/or from a single material. The roll mantle or roll body is preferably made of a relatively corrosion resistant material. Steel has a certain resistance against corrosion. This so-called passivity is due to a thin and invisible layer of oxides being formed on its surface. This process takes place via a reaction between the metal and oxygen in the surrounding environment. The oxide layer reduces the steel's corrosion rate dramatically; it is then said that the material has become passivated i.e. less affected by environmental factors such as air and water. Certain steels are especially adapted to acquire better corrosion resistance. One example of this is stainless steel, where added alloying elements, mainly chromium, give the material very good corrosion protection.

If an entire roll mantle or roll body is made from corrosion resistant material, the additional manufacturing step of coating the roll mantle or roll body with a corrosion resistant material may be eliminated, thereby further reducing manufacturing time, complexity and cost.

According to an embodiment of the disclosure, a roll mantle or roll body is manufactured from steel having the following chemical composition (in weight-%) Cr 13, Ni 4, Mo 1, Mn 1, Si 1, C 0.1, balance Fe and unavoidable impurities. Alternatively, martensitic stainless steel containing at least 12 weight % Cr can be used.

The roll mantle or roll body according to the present disclosure may however be made from any suitable metal or metal alloy, such as steel, a high-strength steel, martensitic steel, or martensitic stainless steel. The roll mantle or roll body according to the present disclosure may be hardfaced, i.e. it may comprise a harder or tougher material which has been applied to at least part of the base material constituting the roll mantle or roll body.

Since the whole roll mantle or roll body may be manufactured from a corrosion resistant metal or metal alloy, such as a low carbon steel (i.e. steel having a maximum carbon content of 0.1 weight-%), only refurbishment of a worn outer surface of the roll mantle or roll body surface will be required since there will be less corrosion on critical roll mantle or roll body surfaces, such as the end regions of the roll mantle or roll body, compared to the end regions of conventional roll mantles or roll bodies which have a core made of less corrosion resistant material, such as high carbon steel. Refurbishment will therefore be less complex and time consuming, and consequently less expensive. A roll mantle or roll body according to the present disclosure may thereby be refurbished significantly more times than a conventional roll mantle or roll body, which extends the useful service life of the roll mantle or roll body and at least part of a roll line containing one or more such roll mantles or roll bodies. The outer surface of a roll mantle or roll body may be refurbished by applying (or re-applying) a protective coating, using any suitable hardfacing method.

According to an embodiment of the disclosure, the method comprises the step of casting the roll mantle or roll body so that it comprises a first end region, a second end region, and a central region in between the first end region and the second end region, whereby the at least one internal channel has at least one located in the central region of the roll mantle or roll body and/or at least one outlet located in the central region of the roll mantle or roll body and whereby the central region extends along at least 50% of the length of the roll mantle or roll body, or at least 60%, at least 70%, or at least 80% of the length of the roll mantle or roll body.

According to an embodiment of the disclosure, the method comprises the step of casting the at least one internal channel so that it comprises at least one of the following features: a pattern, and/or at least one feature, such as a projection on at least part of its inner surface to achieve at least one of the following: to control a flow of fluid flowing through the at least one internal channel; to create turbulence in a fluid flowing through the at least one internal channel; to provide an increased contact surface area to facilitate cooling of a the roll mantle or roll body; and/or to facilitate mounting of equipment, such as a sensor, that is to be placed in the at least one internal channel; a pattern, and/or at least one feature, such as a projection on at least part of an outer surface of said roll mantle or roll body; a uniform or non-uniform cross-section; a uniform or non-uniform cross-sectional area; an extension at a constant or non-constant distance from an outer surface of the roll mantle or roll body; a circular cross-section; a rounded or smooth inside surface; a conical geometry and/or a partition wall.

The method according to the present disclosure may comprise additional steps after a roll mantle or roll body including at least one internal channel has been cast. For example, at least part of the outer surface of the roll mantle or roll body may be machined and/or coated with a surface cladding alloy. According to an embodiment of the disclosure, the surface cladding alloy has a maximum carbon content of 0.1 weight-%.

According to an embodiment of the disclosure the method comprises the step of hardfacing at least part of the roll mantle or roll body. Hardfacing involves the application of a harder or tougher material to at least part of the base metal constituting the roll mantle or roll body, to increase its wear resistance, for example.

Hardfacing can be deposited using any suitable welding method, such as Shielded Metal Arc Welding (SMAW), Gas Metal Arc Welding (GMAW), including both gas-shielded and open arc welding, Oxyfuel Welding (OFW), Electroslag Welding (ESW), Powder Plasma Welding, Thermal Spraying or Laser Cladding.

One layer or two or more layers of hardfacing may be applied after manufacturing a roll mantle or roll body according to the present disclosure and/or when refurbishing a roll mantle or roll body according to the present disclosure. One of the following materials may be applied as hardfacing: a chrome-based alloy, a chrome-nickel based alloy, a cobalt-based alloy, a nickel-based alloy, chromium carbide. For example, one, two or more layers of hardfacing comprising 12 weight-% Cr, 3 weight-% Ni, 1 weight-% Mo may be applied after a roller mantle or roller body according to the present disclosure has been cast, and/or when refurbishing a roller mantle or roller body according to the present disclosure.

The present disclosure also concerns a roll line for a continuous casting apparatus, which comprises at least one roll mantle or roll body according to any of the embodiments of the disclosure.

The present disclosure further concerns a continuous casting apparatus that comprises at least one roll mantle or roll body and/or at least one roll line according to any of the embodiments of the disclosure.

BRIEF DESCRIPTION OF THE DRAWINGS

The present invention will hereinafter be further explained by means of non-limiting examples with reference to the appended schematic figures where.

DETAILED DESCRIPTION

It should be noted that the drawings have not been drawn to scale and that the dimensions of certain features have been exaggerated for the sake of clarity.

Figure 1:
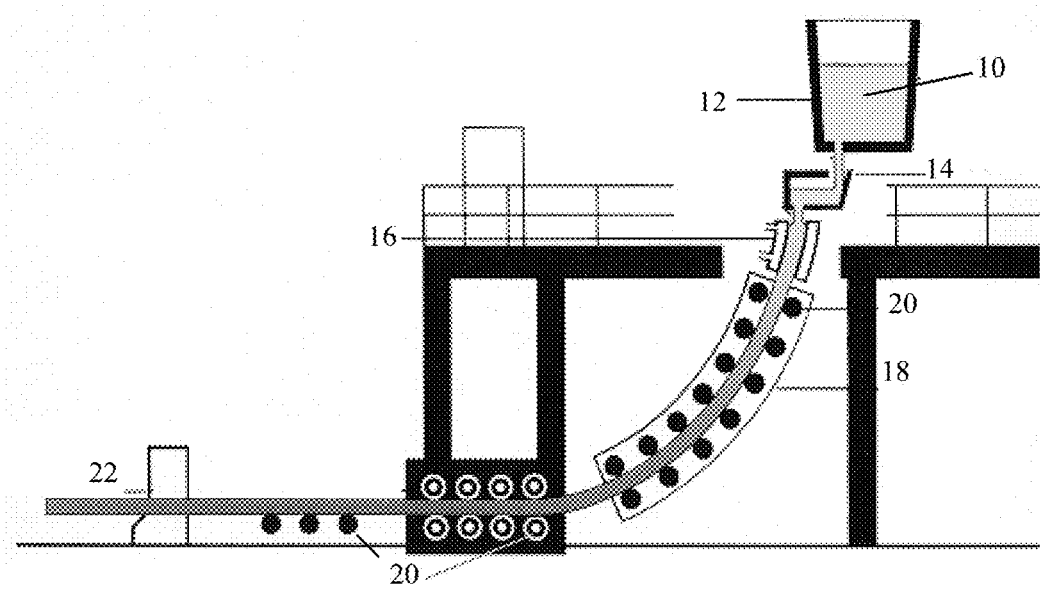
FIG. 1 is a schematic illustration of a continuous casting system.

FIG. 1 shows a system for performing a continuous casting process in which molten metal 10 is tapped into a ladle 12. After undergoing any ladle treatments, such as alloying and degassing, and arriving at the correct temperature, molten metal 10 from the ladle 12 is transferred via a refractory shroud to a tundish 14. Metal is drained from the tundish 14 into the top of an open-base mold 16. The mold 16 is water-cooled to solidify the molten metal directly in contact with it. In the mold 16, a thin shell of metal next to the mold walls solidifies before the middle section, now called a strand, exits the base of the mold 16 into a cooling chamber 18; the bulk of metal within the walls of the strand is still molten. The strand is supported by closely spaced, water-cooled roll lines 20 which act to support the walls of the strand against the ferrostatic pressure of the still-solidifying liquid within the strand. To increase the rate of solidification, the strand is sprayed with large amounts of water as it passes through the cooling chamber 18. Final solidification of the strand may take place after the strand has exited the cooling chamber 18.

In the illustrated embodiment the strand exits the mold 16 vertically (or on a near vertical curved path) and as it travels through the cooling chamber 18, the roll lines 20 gradually curve the strand towards the horizontal. (In a vertical casting machine, the strand stays vertical as it passes through the cooling chamber 18).

After exiting the cooling chamber 18, the strand passes through straightening roll lines (if cast on other than a vertical machine) and withdrawal roll lines. Finally, the strand is cut into predetermined lengths by mechanical shears or by travelling oxyacetylene torches 22 and either taken to a stockpile or the next forming process. In many cases the strand may continue through additional roll lines and other mechanisms which might flatten, roll or extrude the metal into its final shape.

Figure 2A:
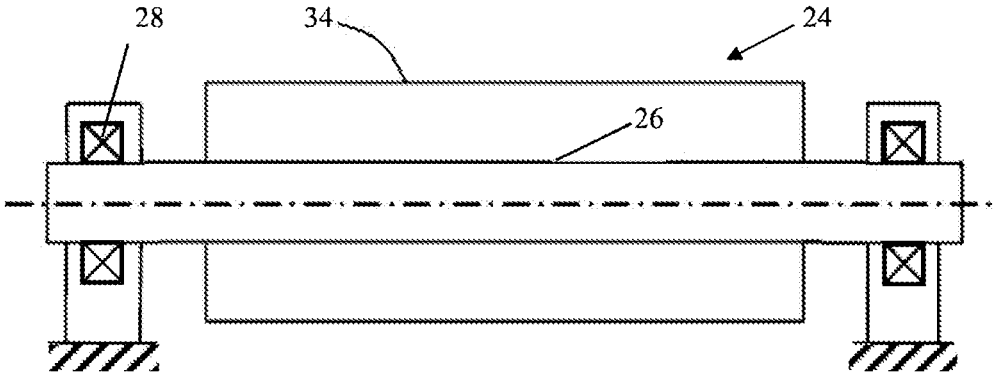
FIG. 2*a* is a side elevational view, partly in section, of a roll mantle according to an embodiment of the disclosure mounted on a rotatable shaft.

FIG. 2*a* shows a roll mantle 24 according to an embodiment of the disclosure. The roll mantle 24 comprises at least one internal channel (not shown in FIG. 2), which roll mantle 24 including its at least one internal channel is produced by casting. The roll mantle may be mounted on a rotatable shaft 26 in a rotationally fixed manner. A roll line 20 of a continuous casting apparatus may for example comprise a common rotatable shaft 26 having an outer diameter and supported by bearings 28, and a plurality of roll mantles 24 fixedly supported on the rotatable shaft 24 for transporting a metal strand along the outer surface 34 thereof, each roll mantle 24 having an inner diameter corresponding to the outer diameter of the rotatable shaft 26.

Figure 2B:
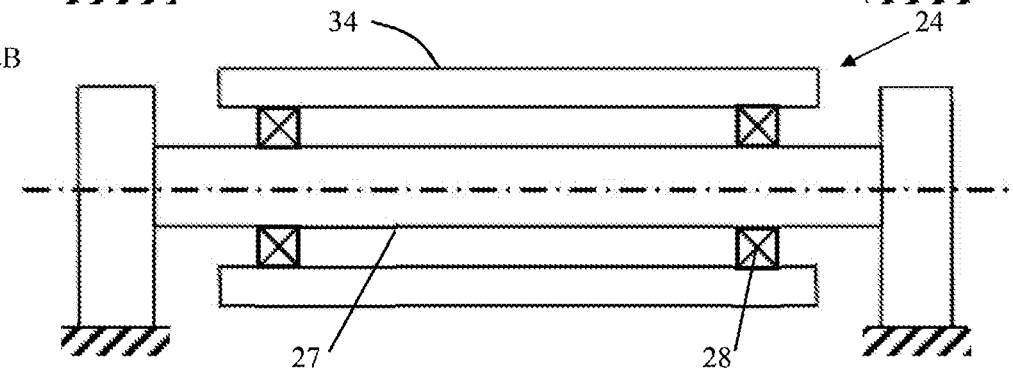
FIG. 2*b* is a side elevational view, partly in section, of a roll mantle according to an embodiment of the disclosure mounted on a on a fixed shaft.

FIG. 2*b* shows an alternative type of roll line design in which a roll mantle 24 according to an embodiment of the disclosure may be arranged to be mounted on a non-rotatable fixed shaft 27 by means of bearings 28, whereby the roll mantle 24 is arranged to be rotatable with respect to the fixed shaft 28.

Figure 2C:
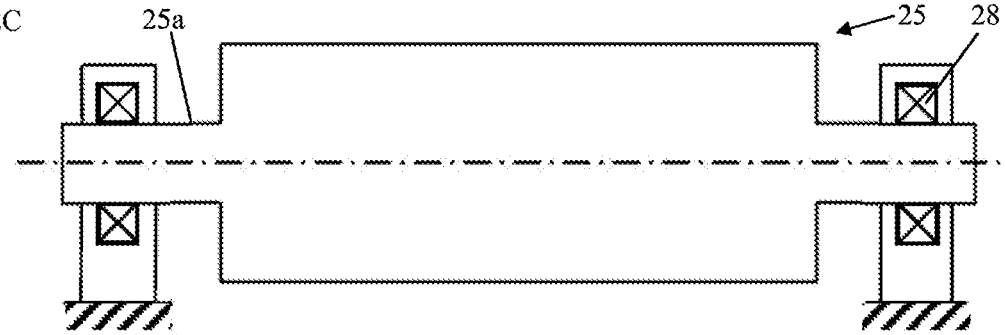
FIG. 2*c* is a side elevational view, partly in section, of a roll body according to an embodiment of the disclosure mounted on an integrated shaft.

FIG. 2*c* shows a roll body 25 according to an embodiment of the disclosure which comprises an integrated shaft 25*a*.

Figure 3:
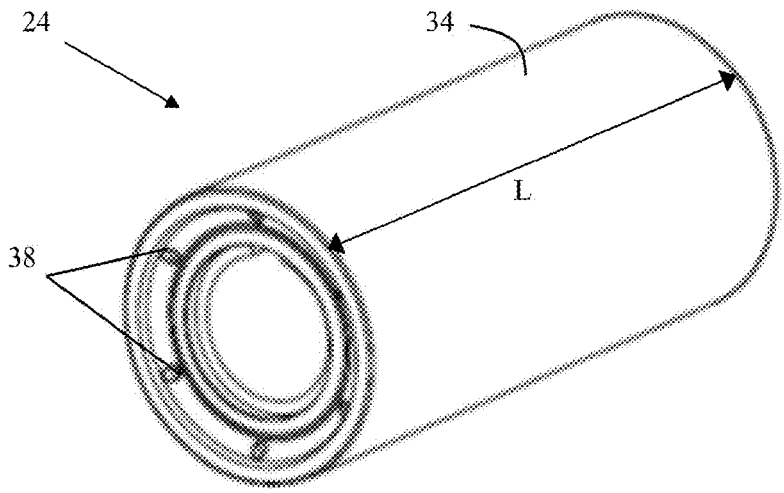
FIG. 3-5 are perspective views of a roll mantle according to an embodiment of the disclosure.
Figure 4:
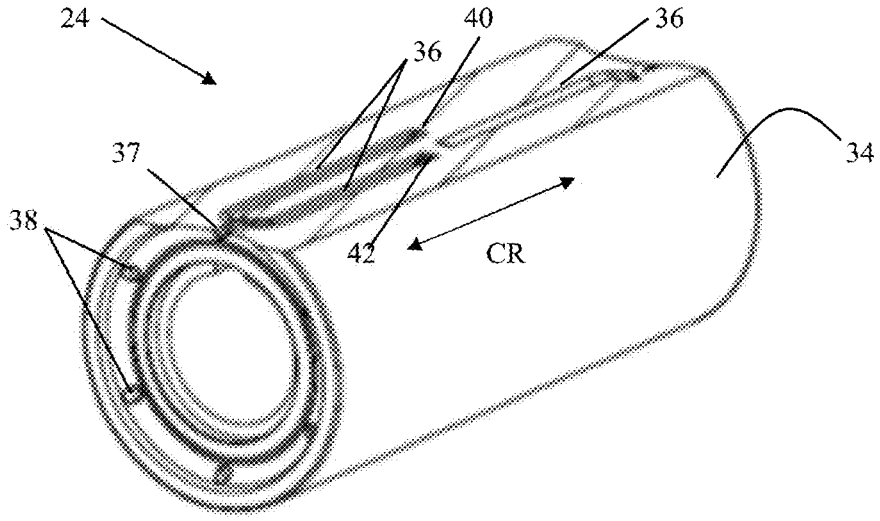
Figure 5:
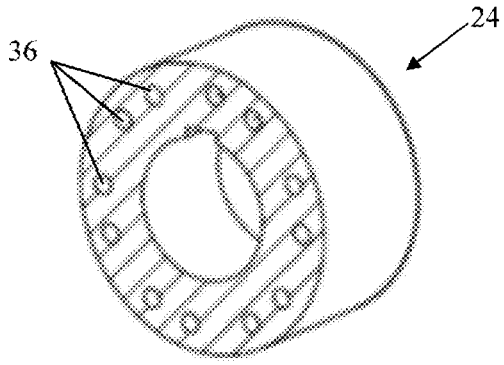

FIGS. 3-5 show a roll mantle 24 comprising a plurality of internal channels 36 that may be used as coolant channels when the roll mantle 24 is in use.

FIG. 3 is a perspective view of a fully cast roll mantle 24 according to the present disclosure having a length L. The length L of a roll mantle 24 may be 400-800 mm. The outer surface 34 of the roll mantle 24 may be provided with a pattern and/or at least one feature by casting during the manufacture of the roll mantle 24. Such a feature may be used to facilitate the transportation of a metal strand along a roll line 20 or to facilitate the cooling of the metal strand. Preferably, a roller mantle or roller body according to the present disclosure does not comprise any hardfacing, thereby reducing manufacturing time, complexity and cost.

FIG. 4 shows the roll mantle with a section cut-away so as to show the extension of a plurality of axial internal channels 36 inside the roll mantle 24. In the illustrated embodiment the roll mantle 24 is provided with peripheral bore cooling (also called revolver cooling) and skewed internal channels 36. However, the at least one internal channel of a roll mantle 24 according to the present disclosure may contain one or more internal channels arranged in any axial, non-axial, radial, non-radial, symmetrical, non-symmetrical, regular or irregular manner, as desired. The internal channel inlets 40 and outlets 42 are preferably arranged in the central region CR of the roll mantle 24.

FIG. 5 shows a cross section of the mid-section of the roll mantle 24. In the illustrated embodiment the roll mantle 24 comprises a plurality of internal channels 36 having a circular cross section which extend mainly in the longitudinal direction of the roll mantle 24. The roll mantle 24 may be mounted on a rotatable shaft 26, whereby the roll mantle 24 is arranged to be supported on the rotatable shaft 26 in a rotationally fixed manner. The rotatable shaft 26 may comprise a coolant line and the internal channels 36 of the roll mantle 34 constitute internal coolant channels arranged to be in fluid communication with the coolant line of the rotatable shaft 26. Coolant, such as water or any other suitable fluid or mixture of fluids, may be fed from the coolant line of the rotatable shaft 26 to the internal channels 36 of the roll mantle 34 at the center of the roll mantle 24 for example, i.e. half way along the roll mantle's length, L or within a central region of the roll mantle.

The at least one coolant inlet 40 and the at least one coolant outlet 42 of a coolant channel 36 may be in fluid communication with a coolant line of a rotatable shaft 26 via one or more radial or non-radial channels in the rotatable shaft 26. It should however be noted that fluid communication between the coolant inlet 40 of a coolant channel 36 and the coolant line may be provided in any suitable manner.

Figure 6:
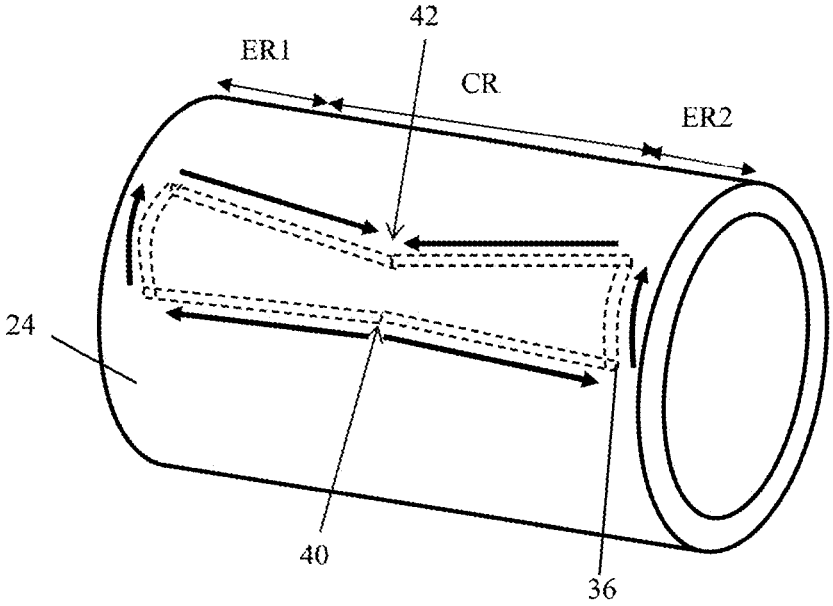
FIG. 6 is a perspective view of a roll mantle according to an embodiment of the disclosure that shows the location of internal channel in the roll mantle.

FIG. 6 shows a roll mantle 24 according to another embodiment of the disclosure in which the roll mantle 24 comprises a first end region (ER1), a second end region (ER2) and a central region (CR) in between the first end region (ER1) and the second end region (ER2). The roll mantle 24 comprises a plurality of internal channels 36, one of which is shown in FIG. 6. The internal channel 36 has an inlet 40 located in the central region (CR) of the roll mantle 24 and an outlet 42 located in the central region (CR) of the roll mantle 24. The central region (CR) extends along at least 50% of the length (L) of the roll mantle.

FIG. 6 shows how coolant may be arranged to flow through a roll mantle 24 according to an embodiment of the present disclosure when the roll mantle 24 is in use. Coolant from a coolant line of a rotatable shaft 26 may be made to flow (by means of pumps, valves and fluid distributors for example) into a plurality of fluid inlets 40 that may be arranged around the inner surface of the roll mantle 24 in the central region CR thereof. Coolant then flows along coolant channels 36 in the roll mantle 24 in the direction indicated by the arrows in FIG. 6 and is returned to the coolant line in the rotatable shaft 26 via at least one fluid outlet 42 that may be arranged around the inner surface of the roll mantle 24 in the central region CR thereof.

Figure 7:
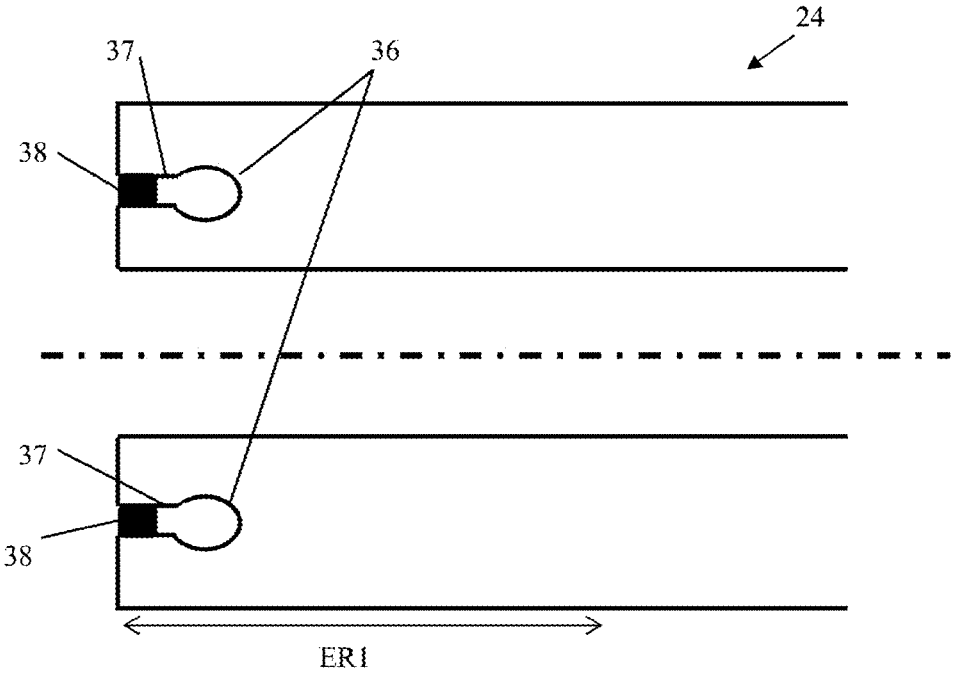
FIG. 7 is a schematic sectional view of plugs at the end of sand core support openings at one end of a roll mantle according to the present disclosure.

FIGS. 3, 4 and 7 show plugs 38 located at one end of the roll mantle 24. These plugs 38 are used to at least partly close, or to seal one or more openings 37 left by a sand core support. A sand core may be used as a mold during the casting of the roll mantle 24 including its at least one internal channel 36. The sand core may need to be supported during the casting. After a roll mantle 24 comprising at least one internal channel 36 has been cast, the sand core is removed and sand core support(s) is/are removed.

Any suitable plug, stopper, or seal 38 made of any suitable material may be used to close, obstruct or seal one or more openings created by the casting process, such as one or more sand core support openings 37. For example, a fixed or removable plug, stopper or seal may be used to partly obstruct, completely block or seal at least part of an opening. According to an embodiment of the disclosure, a plug, stopper or seal 38 is removable so that a sand core support opening it partly obstructs, completely blocks or seals may be used for inspection or cleaning or accessing the internal channels 36.

An internal channel 36 may namely be used to contain coolant, to house equipment, to house at least part of a sensor, to contain a fluid that facilitates assembly and/or disassembly of the roll mantle, to contain lubricant, to allow access to the at least one internal channel from the outside of the roll mantle when the roll mantle is supported on the rotatable shaft.

Figure 8A:
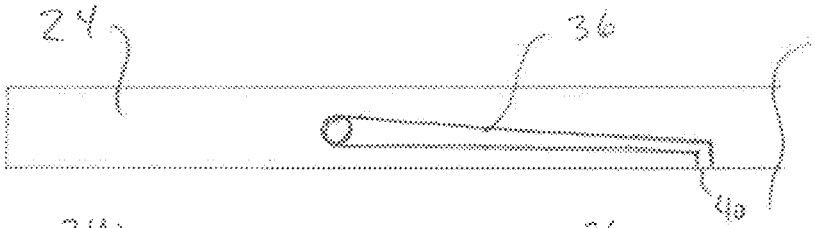
FIG. 8*a*-8*c* illustrate possible configurations of an internal channel in a roll mantle or roll body according to the present disclosure.

According to an embodiment of the disclosure, at least part of the inside surface of an internal channel 36 may comprise a pattern (FIG. 8*c*) and/or at least one feature, such as a projection (FIG. 8*b*), which is/are produced by casting when the roll mantle 24 is manufactured. The pattern or the at least one feature is arranged to control a flow of fluid flowing through the at least one internal channel, to create turbulence in a fluid flowing through the at least one internal channel, to provide an increased contact surface area to facilitate cooling of the roll mantle, to facilitate mounting of equipment, such as a sensor, inside the at least one internal channel.

Figure 8B:
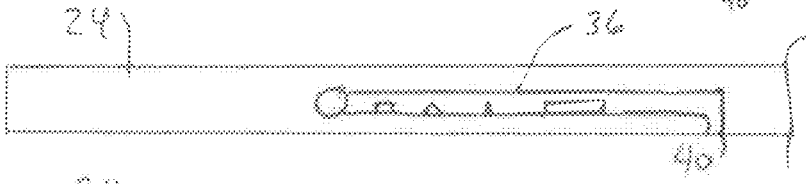
Figure 8C:
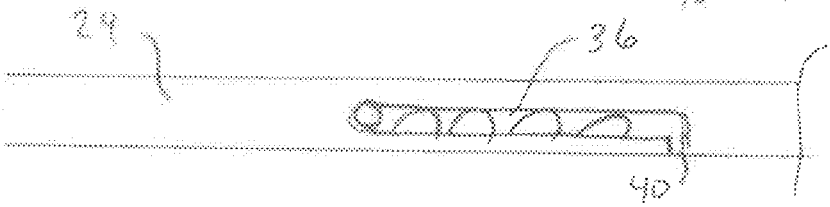

By using casting to manufacture a roll mantle 24 comprising at least one internal channel 36, at least part of an internal channel 36 may be provided with one or more of the following features during casting: a uniform cross section, a non-uniform cross-section (FIG. 8*a*), a uniform or non-uniform cross-sectional area, an extension at a constant distance from an outer surface of the roll mantle, an extension at a non-constant distance from an outer surface of the roll mantle (FIG. 8*a*) a circular cross-section, a rounded or smooth inside surface, a conical geometry (FIG. 8*a*) and/or a partition wall (FIG. 8*b*).

A roll mantle 24 including its at least one internal channel 34 according to any of the embodiments of the disclosure is preferably produced by casting in a single piece from a single material, preferably a corrosion resistant material.

According to an embodiment of the disclosure, the manufacturing method may comprise the step of applying a wear resistant and/or corrosion resistant coating to at least part of the outer surface of the cast roll mantle 24, using any suitable hardfacing method.

Further modifications of the disclosure within the scope of the claims would be apparent to a skilled person.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved roll mantles or roll bodies and methods of making same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

What is claimed is:

1. A method for manufacturing a roll mantle or roll body for a roll line of a continuous casting apparatus comprising a shaft, the method comprising: casting a metal to form the roll mantle or roll body such that the roll mantle or roll body includes at least one internal channel, wherein the casting comprises forming the at least one internal channel so that the at least one internal channel comprises at least one feature on at least part of an inner surface of the at least one internal channel.

2. The method according to claim 1, wherein the at least one feature comprises a pattern.

3. The method according to claim 1, wherein the at least one feature comprises a projection.

4. The method according to claim 1, wherein the at least one feature is configured to:

control a flow of fluid flowing through said at least one internal channel;

create turbulence in a fluid flowing through said at least one internal channel;

provide an increased contact surface area to facilitate cooling of a said roll mantle or roll body; and/or facilitate mounting of equipment that is to be placed in said at least one internal channel.

5. The method of claim 1, wherein the at least one internal channel has:

a uniform or non-uniform cross-section, a uniform or non-uniform cross-sectional area, an extension at a constant or non-constant distance from an outer surface of the roll mantle or roll body, a circular cross-section, a rounded or smooth inside surface, a conical cross-section, and/or a partition wall.

6. The method according to claim 1, wherein the at least one internal channel has a uniform cross-section.

7. The method according to claim 1, wherein the at least one internal channel has a non-uniform cross-section.

8. The method according to claim 1, wherein the casting comprises casting the roll mantle or roll body in a single piece.

9. A method for manufacturing a roll mantle or roll body for a roll line of a continuous casting apparatus comprising a shaft, the method comprising: casting a metal to form the roll mantle or roll body such that the roll mantle or roll body includes at least one internal channel, wherein the at least one internal channel has at least one inlet and at least one outlet and a length from the at least one inlet to the at least one outlet, and wherein the at least one internal channel is formed with a non-uniform cross section along the length.

10. The method according to claim 9, wherein casting the roll mantle or roll body comprises casting the roll mantle or roll body from a corrosion resistant material.

11. The method according to claim 9, wherein the roll mantle or roll body has a first end region, a second end region and a central region between said first end region and said second end region, the central region extending along at least 50% of a length of the roll mantle or roll body, and wherein the casting comprises forming the at least one internal channel in the central region.

12. The method according to claim 9,
including fluidically connecting the at least one internal channel to a coolant line in the shaft.

13. The method according to claim 9,
wherein the casting the roll mantle or roll body comprises casting the roll mantle or roll body in a single piece.

14. The method according to claim 9,
wherein the at least one internal channel has an internal surface and a pattern cast in the at least one internal surface.

15. The method according to claim 9,
wherein the at least one internal channel has an internal surface and a projection cast in the at least one internal surface.

* * * * *